US005221917A

United States Patent [19]

Cummins

[11] Patent Number: 5,221,917

[45] Date of Patent: Jun. 22, 1993

[54] RESISTOR RIBBON FOR RESISTOR GRIDS

[75] Inventor: Robert Cummins, Pittsburgh, Pa.

[73] Assignee: Mosebach Manufacturing Company, Pittsburgh, Pa.

[21] Appl. No.: 893,747

[22] Filed: Jun. 5, 1992

[51] Int. Cl.[5] ..... H01C 3/00

[52] U.S. Cl. ..... 338/281; 338/280; 338/281

[58] Field of Search ..... 338/279, 280, 281, 282

[56] References Cited

U.S. PATENT DOCUMENTS

| | | | |
|---|---|---|---|
| 2,858,402 | 10/1958 | Griffes et al. | 201/69 |
| 3,044,034 | 7/1962 | Vrandenburgh et al. | 338/284 |
| 3,858,149 | 12/1974 | Kirilloff | 338/295 |
| 4,011,395 | 3/1977 | Beck | 13/25 |
| 4,100,526 | 7/1978 | Kirilloff et al. | 338/279 |
| 4,146,868 | 3/1979 | Kirilloff et al. | 338/295 |
| 4,316,172 | 2/1982 | Luy | 338/280 |
| 4,651,124 | 3/1987 | Kirilloff et al. | 338/280 |
| 4,651,125 | 3/1987 | Harkness | 338/295 |
| 4,847,585 | 7/1989 | Kirilloff et al. | 338/58 |

*Primary Examiner*—Marvin M. Lateef
*Attorney, Agent, or Firm*—Buchanan Ingersoll

[57] ABSTRACT

A fan-folded resistor ribbon is provided for use in resistor grids that are used for dynamic braking of diesel electric locomotives. The resistor ribbon is formed, from a continuous strip of resistance material, into flat portions that are connected by semi-tubular end loops. The outer surface of each semi-tubular end loop is an arcuate cylindrical surface that extends an angular distance of more than 180° between the intersection lines where the flat portions join each of the end loops. The flat portions of the ribbon are embossed with one concave embossment and one convex embossment to further stiffen the ribbon material.

8 Claims, 2 Drawing Sheets

RESISTOR RIBBON FOR RESISTOR GRIDS

BACKGROUND OF THE INVENTION

1. Field of the Invention

This invention has to do with resistor grids used for dynamic braking of diesel electric locomotives. It is more particularly concerned with an improved resistor ribbon for the resistor grid that has strength and performance characteristics that are superior to those of conventional resistor ribbons.

2. Description of the Prior Art

Resistor grids of the type generally used in diesel electric locomotives are the subject of Kirilloff et al. U.S. Pat. Nos. 4,100,526 and 4,651,124. An improved resistor grid of their type is that of Kirilloff et al. U.S. Pat. No. 4,847,585. All the above grids have several columns of fanfolded resistor material carrying studs at their folds, which studs fit into insulating bushings carried by the frame of the grid. The fan-folded resistor ribbons are a critical feature of the resistor grids since they must withstand high temperatures and vibration without distorting to a degree that the folds of the ribbon contact each other and short circuit the system. Since the resistor grids are designed to dissipate the energy of electric motor braking by heating the resistor ribbons, the greater the temperature that can be tolerated by the resistor ribbons, the more efficient the resistor grid will be.

SUMMARY OF THE INVENTION

The present invention provides an improved fan-folded resistor ribbon for use in a resistor grid that has at least one column of fan-folded resistor ribbon supported at its folds within a resistor grid frame. The resistor ribbon includes a continuous longitudinal strip of resistance material formed into a series of folds having flat portions connected by semi-tubular end loops. The outer surface of the semi-tubular end loops extend an angular distance of more than 180° between the intersection lines where the flat portions of the ribbon intersect each of the end loops.

The improved fan-folded resistor ribbon to be described in detail hereinafter also includes embossed areas formed on each of the flat portions of the resistor ribbon that extend between adjacent semi-tubular end loops. The embossed portions extend outwardly from the flat portions in different directions from the planes of the respective flat portions so that one of the embossed portions will be concave to a particular surface and another of the embossed portions will be convex to that surface.

DESCRIPTION OF THE PREFERRED EMBODIMENT

Figure 1:
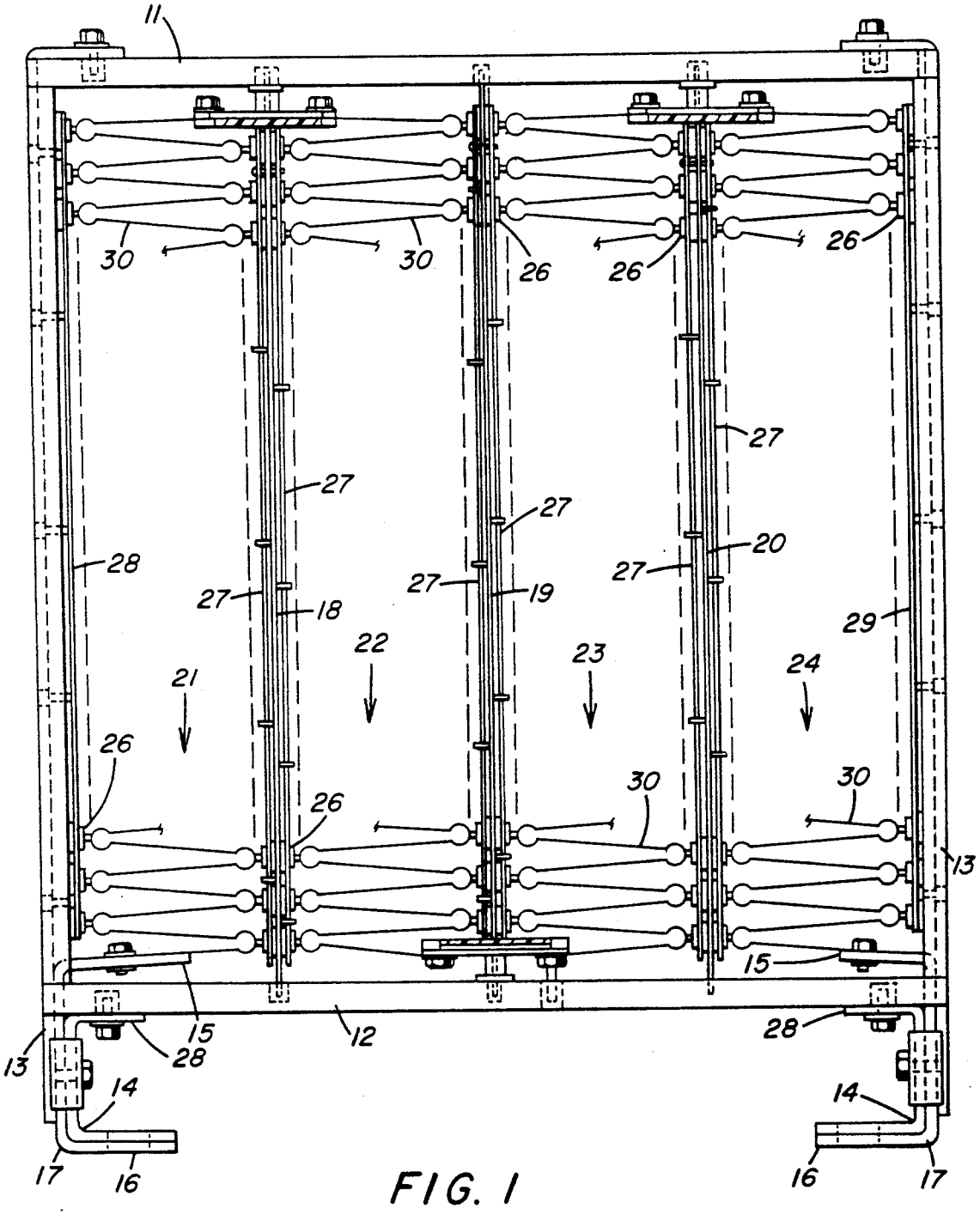
FIG. 1 is an elevation of a typical resistor grid utilizing the improved resistor ribbon of the present invention.
Figure 2:
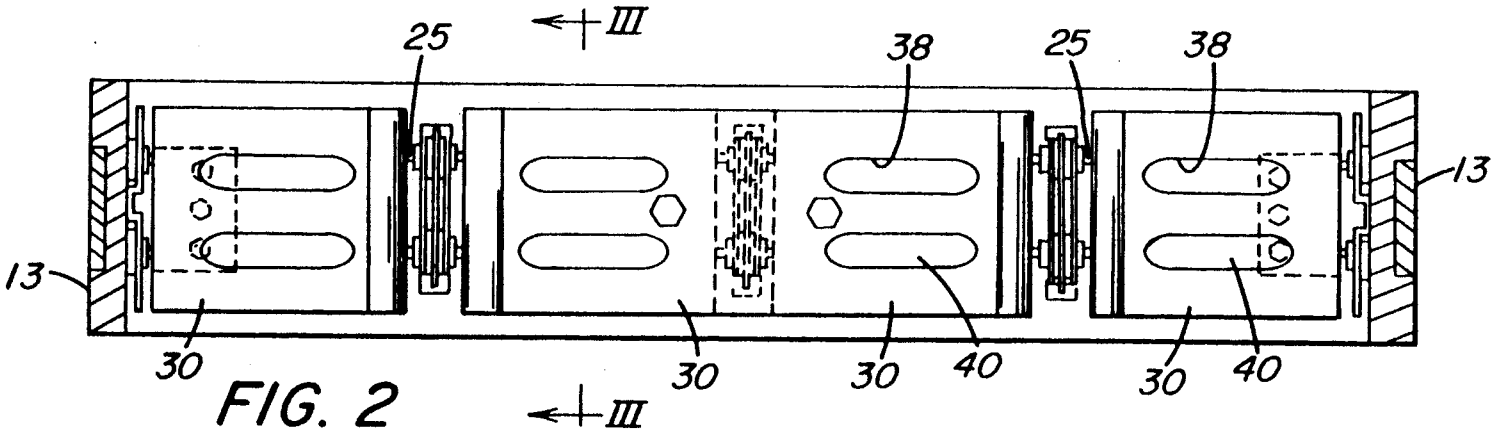
FIG. 2 is an inverted plan of the grid of FIG. 1 viewed from the bottom of FIG. 1 above the frame.
Figure 5:
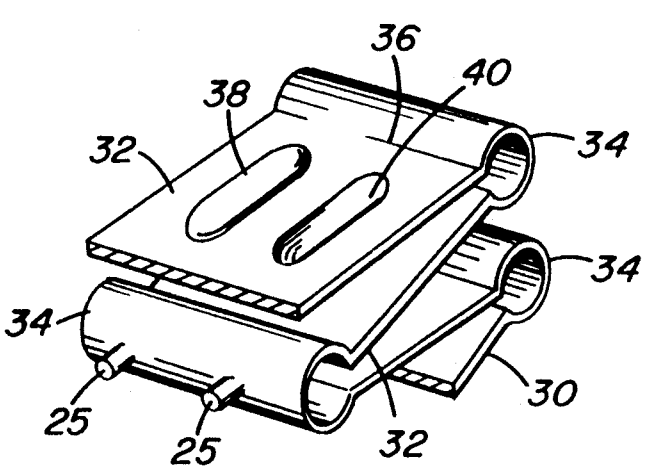
FIG. 5 is a perspective view of a portion of the resistor ribbon.

A resistor grid is assembled in a frame shown in FIG. 1, having a top member 11 and a bottom member 12, preferably of insulating material, and side members 13—13 shown in FIGS. 1 and 2 of metal, preferably steel. Side members 13—13 extend below bottom member 12 and are each bolted to U-shaped metal pieces 14 and 17, the upper leg 15 of each piece 17 is electrically connected to one end of the resistor ribbon, to be described hereinafter, and the lower leg 16 of each piece 17 forms a mounting foot and terminal.

The upper ends of side members 13—13 are bent over and bolted to top member 11; the upper legs 28 of pieces 14 are bolted to bottom member 12.

The space within the frame is divided by vertical steel support plates 18, 19 and 20, into compartments for four columns of fan-folded resistor ribbon 21, 22, 23, and 24. On each fold are fastened two studs 25 shown in FIG. 2 as is known in the prior art, for example Kirilloff et al. U.S. Pat. No. 4,847,585. Those studs 25 mate with insulating bushings 26 usually carried by the frame, as is also known in the art. In the present resistor grid, ceramic bushings 26 carried by support plates 18, 19, and 20, are mounted in a single supported plate 27. The ceramic bushings 26 carried by frame members 13 are mounted in like supported plates 29, which are affixed to those frame members respectively.

Supported plates 29 are mounted on side members 13 and 14 by screws, rivets, or other conventional means. Supported plates 27 are removably mounted on support plates 18, 19, or 20.

The columns of fan-folded resistor ribbon indicated generally at 21, 22, 23, and 24 on FIG. 1 are all formed of identical resistor ribbon 30 shown in greater detail in FIGS. 2 through 5, inclusive. The resistor ribbon 30 of the present invention is formed with flat portions 32 that extend between semi-tubular end loops 34. While the conventional resistor ribbon heretofore known consisted of flat portions that were tangent to 180° end loops, the resistor ribbon 30 of the present invention has semi-tubular end loops that extend an angular distance greater than 180°.

The flat portions 32 of ribbon 30 intersect the semitubular end loops 34 at intersection lines 36. These intersection lines promote lateral stability of the ribbon 30 and prevent it from twisting when heated.

Each flat portion 32 has a concave embossed area 38 and a convex embossed area 40. As viewed in FIGS. 4 and 5, the concave embossed area 38 is depressed into the upper surface of flat portion 32 while the convex embossed area 40 rises above the upper surface of flat portion 32.

The embossed areas 38 and 40 extend generally longitudinally along the flat portions 32 between the semitubular end loops 34. The embossed areas 38 and 40 are generally parallel to each other.

Figure 4:
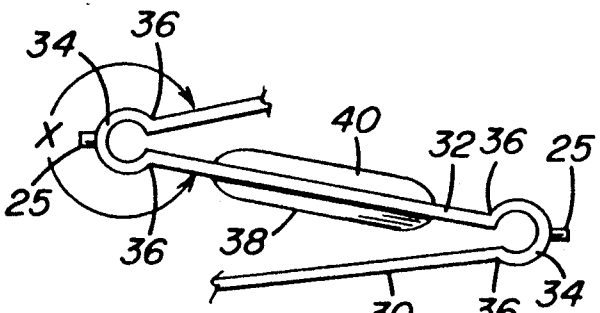
FIG. 4 is a side elevation of a portion of the resistor ribbon showing details of its construction.
Figure 3:
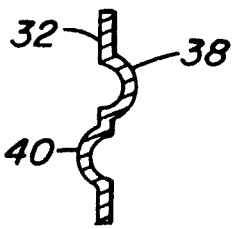
FIG. 3 is a cross section of the resistor ribbon taken along the III—III of FIG. 2.

As shown in FIG. 4, the semi-tubular end loops 34 extend an angular distance "X" which is always greater than 180° and is preferably greater than 280° between the intersection lines 36 where the flat portions 32 meet the semi-tubular end loops 34.

While earlier resistor ribbon, particularly that disclosed in U.S. Pat. No. 4,847,585, has utilized embossed areas on the flat portions of the resistor ribbon to stiffen the ribbon, it has not been known to provide semi-tubular end loops on the fan-folded resistor ribbon to provide a lateral intersection line between the semi-tubular loops and the flat portions of the resistor ribbon.

In destructive testing of resistor grids utilizing the fan-folded resistor ribbon 30 of the present invention and conventional fan-folded resistor ribbon as shown in U.S. Pat. No. 4,847,585, the resistor ribbon 30 of the present invention maintained its shape and did not short circuit the resistor grid long after the conventional resistor ribbon twisted and warped and caused short circuits in the resistor grid.

According to the provisions of the patent statutes, we have explained the principle, preferred construction and mode of operation of our invention and have illustrated and described what we now consider to represent its best embodiment. However, it should be understood, that within the scope of the appended claims, the invention may be practiced otherwise than as specifically illustrated and described.

We claim:

1. An improved fan-folded resistor ribbon for use in a resistor grid having at least one column of fan-folded resistor ribbon supported at its folds within a resistor grid frame, said resistor ribbon comprising a continuous longitudinal strip of resistance material formed into a series of folds having flat portions connected by semi-tubular end loops, the outer surface of each of said semi-tubular end loops being an arcuate cylindrical surface that extends an angular distance of more than 180° between the intersection lines where said flat portions join each of said end loops, said intersection lines being elements of said cylindrical surface.

2. The improved fan-folded resistor ribbon of claim 1 wherein said flat portions each have embossed areas to stiffen said flat portions.

3. The improved fan-folded resistor ribbon of claim 2 wherein at least two of said embossed areas extend outwardly from said flat portions in different directions from the planes of the respective flat portions.

4. The improved fan-folded resistor ribbon of claim 1 wherein said resistance material is metal.

5. The improved fan-folded resistor ribbon of claim 1 wherein studs are attached to said semi-tubular end loops to facilitate support of said resistor ribbon within said grid frame.

6. An improved fan-folded resistor ribbon for use in a resistor grid having at least one column of fan-folded resistor ribbon supported at its folds within a resistor grid frame, said resistor ribbon comprising a continuous longitudinal strip of metal formed into a series of folds having flat portions connected bay semi-tubular end loops, the outer surface of each of said semi-tubular end loops being an arcuate cylindrical surface that extends an angular distance of at least 280° between the intersection lines where said flat portions join each of said end loops, said intersection lines being elements of said cylindrical surface, said flat portions each having a plurality of embossed areas to stiffen said flat portions, at least two of said embossed areas extending outwardly from said flat portions in different directions form the planes of said respective flat portions, each of said semi-tubular end loops having metal studs welded to said end loops and extending radially outwardly form said end loops to facilitate support of said resistor ribbon within said grid frame.

7. The improved fan-folded resistor ribbon of claim 6 wherein said embossed areas on each of said flat portions are two in number and extend in a generally longitudinal direction between adjacent semi-tubular end loops, one of said embossed areas being concave to a first surface of said flat portions and the other of said embossed areas being convex to said first surface.

8. The improved fan-folded resistor ribbon of claim 7 wherein said embossed areas are elongated and positioned generally parallel to each other.

* * * * *